US005369557A

United States Patent [19]

Ronney

[11] Patent Number: 5,369,557

[45] Date of Patent: Nov. 29, 1994

[54] HIGH-POWER XENON-ARC SEARCHLIGHT WITH UNLIMITED VERTICAL BEAM DIRECTION

[75] Inventor: Kenneth R. Ronney, Reseda, Calif.

[73] Assignee: Hughes Aircraft Company, Los Angeles, Calif.

[21] Appl. No.: 854,029

[22] Filed: Mar. 19, 1992

[51] Int. Cl.[5] ..... F21V 21/30

[52] U.S. Cl. ..... 362/285; 362/263; 362/269; 362/298

[58] Field of Search ..... 362/263, 269, 272, 285, 362/286, 287, 346, 297, 428, 35, 298, 296, 2, 293, 419

[56] References Cited

U.S. PATENT DOCUMENTS

| | | | |
|---|---|---|---|
| 329,930 | 5/1930 | Roche | 362/296 |
| 892,087 | 6/1908 | Rey | 362/296 |
| 1,279,096 | 9/1918 | Gerald | 362/298 |
| 1,659,897 | 2/1928 | Schoenfeld | 362/349 |
| 1,683,895 | 9/1928 | Jacob | 362/349 |
| 3,202,811 | 8/1965 | Hall, Jr. | 362/2 |
| 3,443,086 | 5/1969 | Rikis | 362/346 |
| 3,648,045 | 3/1972 | Le Yantine et al. | 362/285 |
| 3,702,395 | 11/1972 | Rosendahl | 362/263 |
| 3,758,769 | 9/1973 | Pichel | 362/286 |
| 4,423,471 | 12/1983 | Gordin et al. | 362/287 |
| 4,510,558 | 4/1985 | van den Brink | 362/263 |
| 4,729,077 | 3/1988 | Gordin et al. | 362/285 |
| 4,935,853 | 6/1990 | Collins | 362/287 |

FOREIGN PATENT DOCUMENTS

| | | | |
|---|---|---|---|
| 1085420 | 7/1960 | Germany | 362/263 |
| 2082403 | 3/1990 | Japan | 362/350 |

OTHER PUBLICATIONS

Van Nostrands's Scientific Encyclopedia, 7th Ed., Van Nostrand Reinhold, 1989, p. 1524.

CRC Handbook of Tables for Applied Engineering Science, 2nd Ed., CRC Press, 1973, p. 679.

*Primary Examiner*—Richard R. Cole
*Assistant Examiner*—Y. Quach
*Attorney, Agent, or Firm*—Elizabeth E. Leitereg; Terje Gudmestad; W. K. Denson-Low

[57] ABSTRACT

A searchlight (40) includes a high-power xenon-arc lamp (12) having a longitudinal axis (16), and an anode (18) and cathode (20) which are spaced from each other along the axis (16). The lamp (12) becomes inoperative when the anode (18) is disposed below the cathode (20) by more than a small distance. A first reflector (28) is integrally movable with the lamp (12) and has a parabolic reflecting surface (28*a*) for collecting light from the lamp (12) and reflecting the collected light generally parallel to the axis (16) as a beam (34). A second reflector (44) is also integrally movable with the lamp (12) for receiving the beam (34) from the first reflector (28) and reflecting the beam (48) away from the axis (16) at a right angle. With the anode (18) of the lamp (12) maintained at the same height as or above the cathode (20) and the searchlight (40) rotated such that the axis (16) sweeps a 180° arc from horizontal through vertical to horizontal, the beam (48) from the second reflector (44) sweeps a 180° arc from vertically downward through horizontal to vertically upward. The xenon-arc lamp (12) produces an arc (25) including proportionally more short wavelength light, notably blue light, than in sunlight. The first and/or second reflectors (28,44) have gold reflecting surfaces (43,44*d*) which partially attenuate shorter wavelength light from blue through ultraviolet such that the beam (48) more closely approximates sunlight for better color rendition of illuminated objects.

11 Claims, 3 Drawing Sheets

HIGH-POWER XENON-ARC SEARCHLIGHT WITH UNLIMITED VERTICAL BEAM DIRECTION

BACKGROUND OF THE INVENTION

1. Field of the Invention

The present invention generally relates to the field of high intensity illumination devices, and more specifically to a high-power xenon-arc searchlight which has a continuous vertical beam direction range from straight down through straight up.

2. Description of the Related Art

Xenon-arc lamps provide an efficient source of high intensity illumination for a diverse range of applications, including light sources for cinematography and mobile searchlights carried by helicopters. An exemplary xenon-arc lamp application is disclosed in U.S. Pat. No. 3,720,822, entitled "*XENON PHOTOGRAPHY LIGHT*", issued Mar. 13, 1973 to J. Rochester et al.

The main elements of a photography light 10 as disclosed by Rochester are illustrated in FIG. 1. A xenon-arc lamp 12 includes a quartz tube 14 which is filled with xenon gas and has a longitudinal axis 16. An anode 18 and a cathode 20 are disposed inside the tube 14 and spaced from each other along the axis 16. An anode contact 22 and a cathode contact 24 enable connection of the anode 18 and cathode 20 respectively to an external direct current (DC) power source (not shown).

Upon application of DC power to the lamp 12, the xenon gas in the tube 14 is ionized and a high intensity luminous arc 25 is formed between the anode 18 and cathode 20 having maximum intensity at a point 26. A concave reflector 28 having a reflecting surface 28*a* with a parabolic, elliptical, aconic, spherical, or other suitable cross-section is mounted relative to the lamp 12 such that the reflecting surface 28*a* faces the lamp 12 and the central axis of the cross-section of the reflector 28 coincides with the axis 16 of the lamp 12. A reflecting layer 28*b* of aluminum or rhodium is formed on the surface 28*a*. Alternatively, although not shown, the reflector 28 may be transparent, and a reflecting layer formed on the rear surface of the reflector 28. The anode 18 is disposed between the reflector 28 and cathode 20.

Assuming that the reflecting surface 28*a* has a parabolic cross-section with a focus 30, the lamp 10 produces a narrow or tightly focussed beam when the reflector 28 is in the position illustrated such that the focus 30 of the reflecting surface 28*a* coincides with the point 26 of maximum intensity of the arc 25. Light from the arc 25 is collected by the reflector 28 as indicated by arrows 32, and reflected out of the lamp 10 along (generally parallel to) the axis 16 as a beam indicated by arrows 34.

FIG. 2 illustrates how the light 10 can be manipulated to produce a wider, less focussed beam, and plots the luminous intensity of the arc 25 as a function of displacement from the point 26 for a typical xenon-arc lamp 12. The curves indicate the luminous intensity in candela per square centimeter. It will be seen that in the illustrated example, the luminous intensity is 2,260 at the point 26, and decreases as a function of displacement from the point 26 toward the anode 18 to a value of 150 adjacent to the anode 18.

In the solid line position of the reflector 28 as shown in FIG. 2, the focus 30 of the reflecting surface 28*a* coincides with the point 26 of maximum intensity of the arc 25, and the light 10 radiates a beam with maximum focus and minimum width. The actual beam width varies with the size of the lamp 12 and the type of reflector 28. For an exemplary lamp 12 having a power rating of 500 watts and a parabolic reflector 28 having a focal length of 1.9 cm, the minimum width beam will have a divergence on the order of 1°.

The focus can be progressively reduced and the beam made progressively wider by moving the reflector 28 upwardly toward a broken line position as indicated at 28'. In this case, the focus, here designated as 30', is closer to the anode 18 than in the position 26, such that the reflector 28' collects light from a larger portion of the arc 25 and produces a wider beam with divergence on the order of 12°.

The focus and beam width are continuously variable between approximately 1° and 12° in the manner described. It is also possible to position the reflector 28 and lamp such that the cathode 18 is disposed between the reflecting surface 28*a* and the anode 20. In this case, the beam is defocussed by moving the reflector 28 toward the lamp 12, opposite to the operation described with reference to FIG. 2. However, this arrangement is less desirable since possible range of focus is smaller, on the order of 1° to 6°.

The prior art configuration illustrated in FIGS. 1 and 2 is satisfactory for lights with low-power (less than approximately 300 watt) xenon-arc lamps, and applications such as helicopter-mounted searchlights which are only required to direct their beams from slightly above horizontal to vertically downward. Low-power xenon-arc lamps will operate at any orientation. However, a higher-power xenon-arc lamp becomes inoperative if oriented such that the anode 18 is disposed below the cathode 20 by more than a small distance. More specifically, the arc 25 will become unstable or extinguish if the anode 18 is disposed below the cathode 20, and the longitudinal axis 16 is inclined by more than a predetermined angle $\theta$, typically on the order of 15°, from the horizontal.

The operating range of a conventional high-power xenon-arc 10 is illustrated in FIGS. 3*a* to 3*c*. FIG. 3*a* illustrates one extreme operative orientation in which the anode 18 is leftward of and below the cathode 20, and the axis 16 is inclined by the angle $\theta$ from the horizontal which is indicated at 36. FIG. 3*b* illustrates the ideal operating condition of the light 10, rotated 105° clockwise from the position of FIG. 3*a*, in which the anode 18 is disposed directly above the cathode 20. FIG. 3*c* illustrates the opposite extreme operating condition of the lamp 10, rotated 105° clockwise from the position of FIG. 3*b*, in which the anode 18 is rightward of and below the cathode 20 and the axis 16 is inclined by $\theta$ from the horizontal 36.

The prior art light 10 is thereby operative with a vertical or elevation range of 210°, extending from 15° above the horizontal 36 in one direction, through vertically downward to 15° above the horizontal 36 in the opposite direction. However, numerous applications require a searchlight having an unlimited range of vertical beam direction, extending from straight up through horizontal to straight down.

The requirement that the anode of a xenon-arc lamp not be oriented below the cathode can be satisfied while providing a full vertical range of beam direction by mounting the lamp horizontally and rotating the reflector in a vertical plane which is perpendicular to the axis of the lamp. Although this arrangement is acceptable in applications in which the beam width is maintained in the most narrowly focussed state, attempts to provide a wider beam width result in an extremely asymmetric beam.

It is also possible to maintain the lamp vertical or horizontal, and rotate the reflector about the lamp using a gimbal arrangement. However, this is difficult and expensive to embody in actual practice, since the displacement of the lamp and reflector between the minimum and maximum beam width positions is very small, on the order of 4–5 millimeters. The mechanical tolerances of a gimbal mechanism required to maintain a fixed beam width over the entire vertical beam range are very close and expensive to achieve and maintain under conditions such as encountered by helicopter and other ground, airborne and marine vehicle-mounted searchlights which are subject to heavy vibration. In addition, the gimbal arrangement is usable for only relatively small lamps, since larger lamps mechanically interfere with the movement of the reflector and gimbal mechanism.

The reflecting layer 28*b* of the reflector 28 has conventionally been formed of aluminum, silver, rhodium or multi-layer dielectric materials. However, these materials have various disadvantages. Aluminum has poor resistance to atmospheric corrosion. Silver tarnishes quickly upon exposure to air, and for this reason can only be used on the rear surface of the reflector 28. Rhodium is extremely expensive, and can only be used in thin layers which are sensitive to atmospheric conditions and easily damaged by cleaning. Multi-layer dielectrics only reflect light in a narrow wavelength band, are expensive to produce, and are also easily damaged by cleaning.

Gold has been used as reflecting material in infrared optical systems. However, it has not been employed in visible optical systems since it has relatively low reflectivity in the shorter visible wavelengths, notably the blue region. Although more expensive than aluminum and silver, gold is much less expensive than rhodium, and is highly resistant to tarnish and corrosion.

SUMMARY OF THE INVENTION

A searchlight embodying the present invention overcomes the drawbacks of the prior art by providing a full vertical range of beam direction without requiring an expensive and delicate reflector gimbal mechanism. The present searchlight further maintains a symmetrical beam shape over a full focussing range.

More specifically, the present searchlight includes a high-power xenon-arc lamp having a longitudinal axis, and an anode and cathode which are spaced from each other along the axis. The lamp becomes inoperative when the anode is disposed below the cathode by more than a small distance.

A first reflector is integrally movable with the lamp and has a parabolic reflecting surface for collecting light from the lamp and reflecting the collected light generally parallel to the axis as a beam. A second reflector is also integrally movable with the lamp for receiving the beam from the first reflector and reflecting the beam away from the axis at a right angle.

With the anode of the lamp maintained at the same height as or above the cathode and the searchlight rotated such that the axis sweeps a 180° arc from horizontal, through vertical to horizontal, the beam from the second reflector sweeps a 180° arc from vertically downward, through horizontal to vertically upward.

The xenon-arc lamp produces an arc having proportionally more short wavelength light, notably blue light, than in sunlight. The first and/or second reflectors have gold reflecting surfaces which partially attenuate shorter wavelength light from blue through ultraviolet such that the beam reflected therefrom closely approximates sunlight for better color rendition of illuminated objects.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 4:
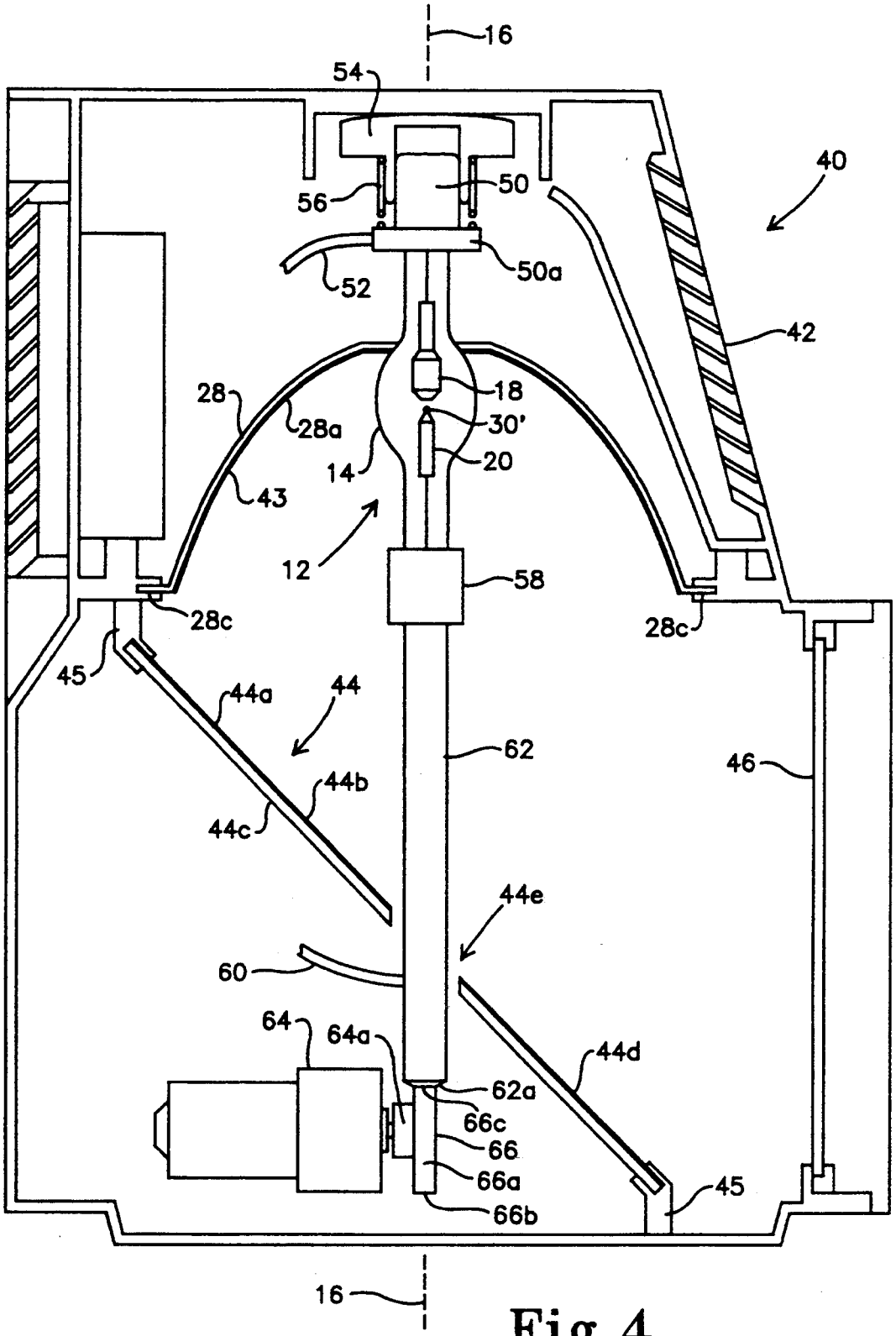
FIG. 4 is a side elevation, partially in section, illustrating a searchlight embodying the present invention.

A searchlight 40 embodying the present invention is illustrated in FIG. 4, and includes elements which are common to the prior art light 10 and designated by the same reference numerals. The searchlight 40 includes a housing 42 which supports the lamp 12 and reflector 28 therein. The reflector 28 is fixed to the housing 42 at its peripheral edge as indicated at 28*c*, whereas the lamp 12 is movable along the axis 16 for focussing. The reflecting layer 28*b* of the prior art is preferably replaced by a gold reflecting layer 43 which is formed on the concave reflecting surface 28*a* of the reflector 28. The lamp 12 is oriented such that the anode 18 is disposed between the reflector 28 and the cathode 20.

In accordance with the invention, a plane mirror 44 is fixedly supported below the lamp 12 by brackets 45. The mirror 44 includes a substrate in the form of a flat plate 44*a* having a first surface 44*b* which faces the lamp 12, and a second surface 44*c* which faces away from the lamp 12. A gold reflecting layer 44*d* is formed on the first surface 44*b*. Although it is within the scope of the invention to make the plate 44*a* of the mirror 44 transparent and form the reflecting layer 44*d* on the second surface 44*c* rather than the first surface 44*b*, the illustrated arrangement is preferable since it eliminates absorption of light which would occur during two passes of the beam 48 through the plate 44*a*.

In the most preferred embodiment of the invention, the mirror 44 is oriented at an angle of 45° to the axis 16, such that light from the lamp 12 which is collected by and reflected downwardly by the reflector 28 is received by and reflected rightwardly by the mirror 44 out of the housing 42 through a window 46. Since the reflector 28, mirror 44 and lamp 12 are retained inside the housing 42, they are integrally movable therewith.

A handle (not shown) may be provided on the top of the housing 42 for handheld use of the searchlight 40. Alternatively, a conventional motor-driven gimbal mechanism (not shown) may be provided for mounting the housing 42 on a vehicle such as a helicopter for remote control from inside the vehicle. In either case, the housing 42 can be rotated in the yaw direction (about a vertical axis) to provide a full 360° range of horizontal beam direction. The housing 42 can also be rotated in the pitch direction (about a horizontal axis) to provide a range of least 180° of vertical beam direction from straight down to straight up. These two degrees of freedom of movement enable the searchlight 40 to direct its beam in any direction.

Figure 5A:
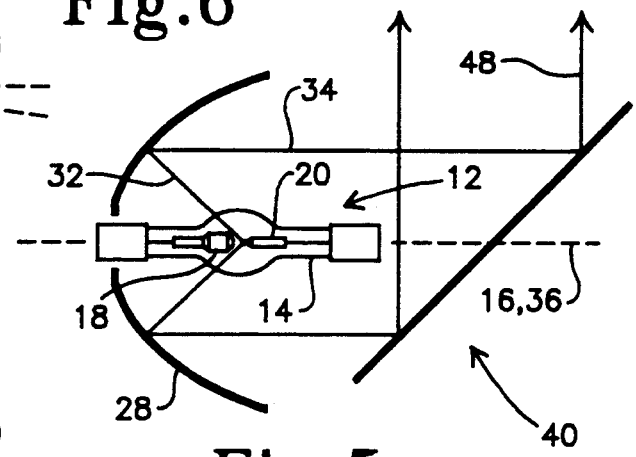
FIGS. 5*a* to 5*c* are simplified diagrams illustrating the vertical range of beam direction of the present searchlight.
Figure 5B:
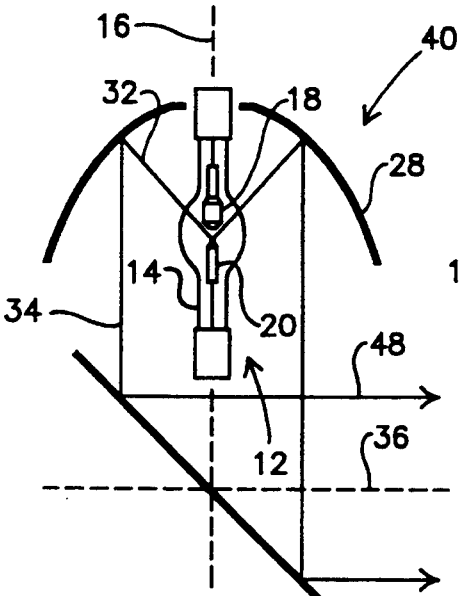
Figure 5C:
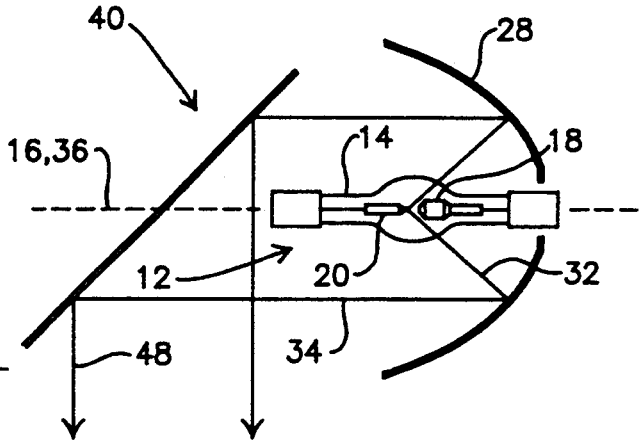

FIGS. 5*a* to 5*c* illustrate how the present searchlight 40 provides a full vertical range of beam direction. In FIG. 5*a*, the searchlight 40 is oriented such that the axis 16 is horizontal, and the anode 18 is rightward of the cathode 20. The output beam of the searchlight 40, as indicated by arrows 48, is directed vertically upward (straight up).

In FIG. 5*b*, the searchlight 40 is rotated 90° clockwise from the position of FIG. 5*a*, the anode 18 is directly above the cathode 20, and the beam 48 is directed horizontally rightward.

In FIG. 5*c*, the searchlight 40 is rotated 90° clockwise from the position of FIG. 5*b*, the anode 18 is rightward of the cathode 20, and the beam 48 is oriented vertically downward (straight down).

The anode 18 is either at the same height as the cathode 20 in the extreme positions of FIGS. 5*a* and 5*c* respectively, or above the cathode 20 in all positions intermediate between those of FIGS. 5*a* and 5*c*. Thus, the goal of providing a full vertical range of beam direction without having the anode 18 disposed below the cathode 20 is achieved. In addition, the lamp 12 and reflector 28 are maintained coaxial over the entire vertical range of beam direction, thereby enabling precise focussing with a symmetrical beam over the entire focussing range.

It will be noted that the maximum range of vertical beam direction of the present searchlight 40 actually extends further than as illustrated in FIGS. 5*a* to 5*c*, more specifically from $\theta$ counterclockwise of the position of FIG. 5*a* to $\theta$ clockwise of the position of FIG. 5*c*. Where a different range of vertical beam direction is required for a special application, it is within the scope of the invention to orient the mirror 44 at an angle other than 45° to the axis 16 such that the beam is reflected by the mirror 44 away from the axis 16 at an angle other than 90°.

Focussing is accomplished in the embodiment illustrated in FIG. 4 by maintaining the reflector 28 fixed in the housing 42 and moving the lamp 12 along the axis 16. However, it is within the scope of the invention to accomplish focussing as disclosed by Rochester by fixing the lamp 12 and moving the reflector 28 along the axis 16.

As illustrated in FIG. 4, a socket 50 having a cylindrical outer surface is fixed to the upper end of the lamp 12. A cable 52 leads from the socket 50 for connecting the anode contact 22 to the power source. The socket 50 is received in a bushing 54 for vertical sliding movement. A compression spring 56 disposed between the bushing 54 and a flange 50*a* of the socket 50 urges the socket 50 and thereby the lamp 12 downwardly.

The lower end of the lamp 12 is received in a socket 58. An electrically conductive pushrod 62 is connected to the cathode contact 24 and extends downwardly from the socket 58 along the axis 16 through a hole 44*e* formed through the mirror 44. The lower end of the pushrod 62 terminates in a cam follower 62*a*. A cable 60 extends from the pushrod 62 underneath the mirror 44, so as not to interfere with the light beam 34 from the reflector 28, for connection of the cathode contact 24 to the power source.

Figure 1:
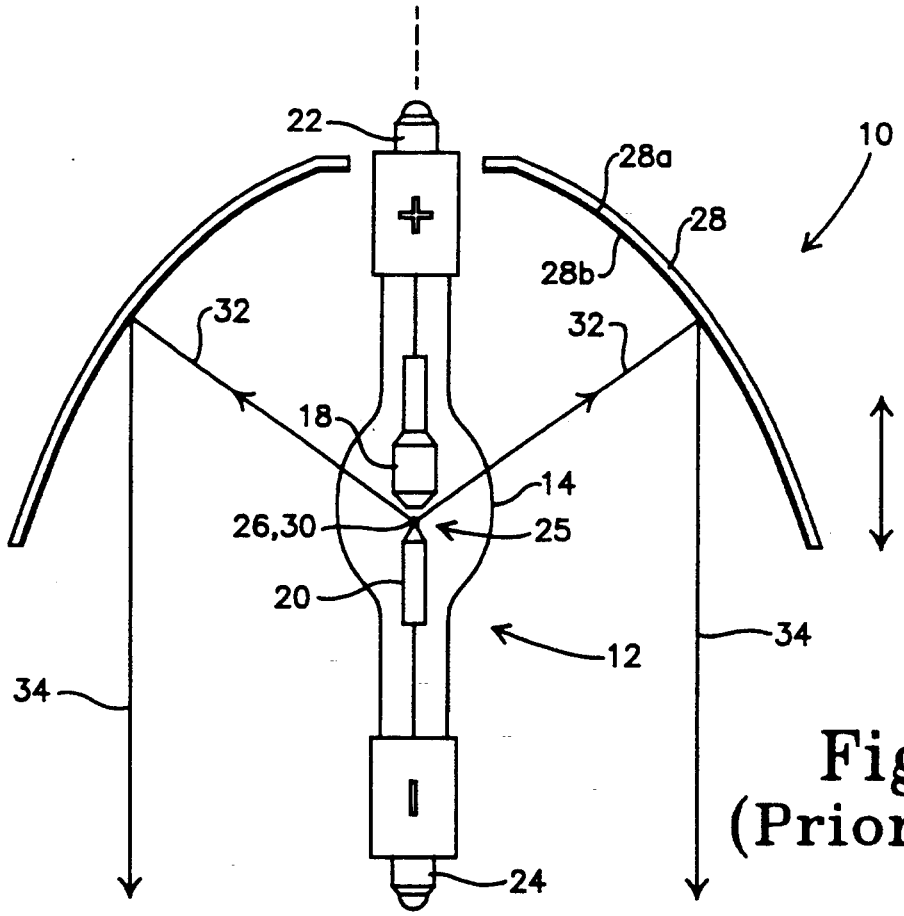
Fig.1 (Prior Art)
FIG. 1 is a simplified diagram illustrating a prior art xenon-arc light.
Figure 2:
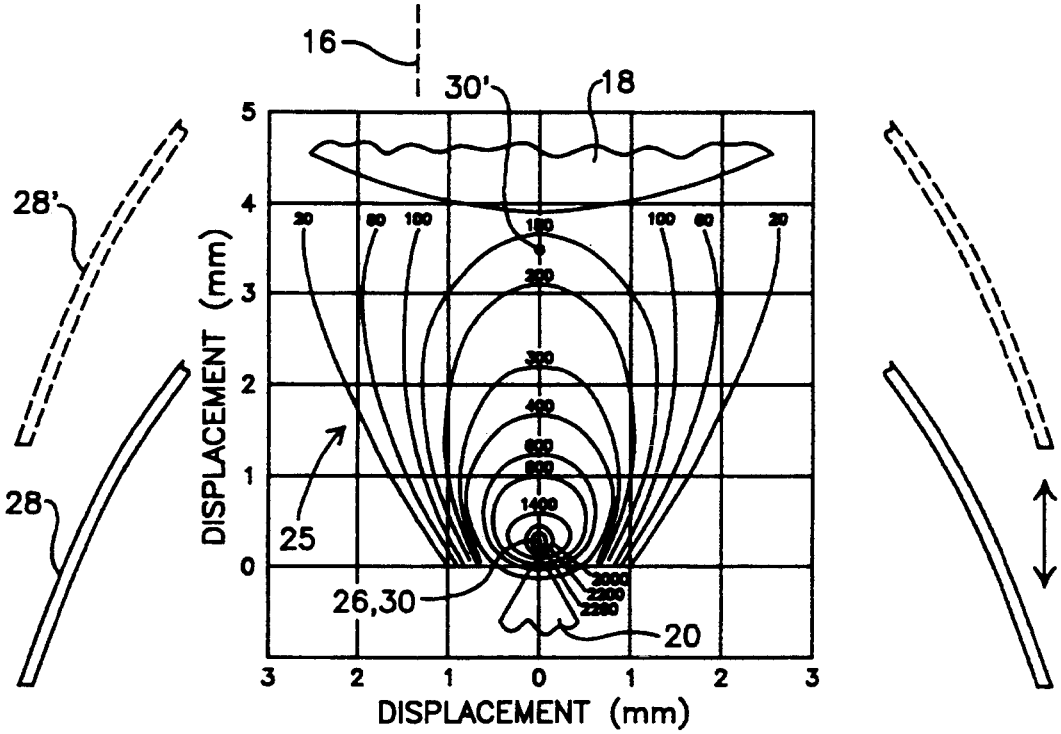
Fig.2 (Prior Art)
FIG. 2 is a graphical diagram illustrating the focussing arrangement of the light shown in FIG. 1.
Figure 3A:
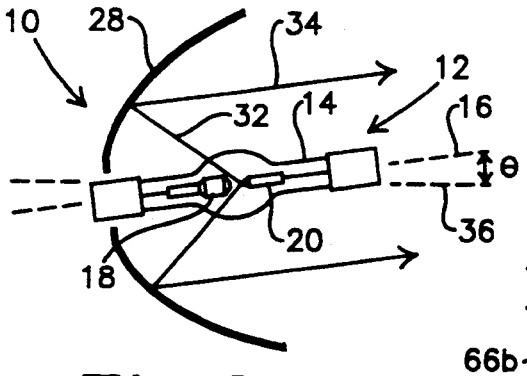
Fig.3a (Prior Art)
FIGS. 3*a* to 3*c* are simplified diagrams illustrating the vertical range of operation of the light shown in FIG. 1.
Figure 6:
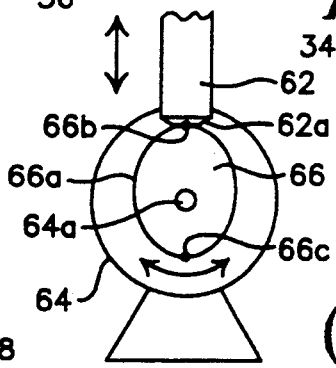
FIG. 6 is a fragmentary front elevation illustrating a focussing mechanism of the present searchlight.
Figure 3B:
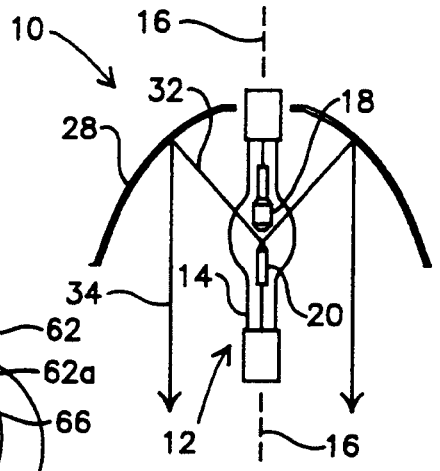
Fig.3b (Prior Art)
Figure 3C:
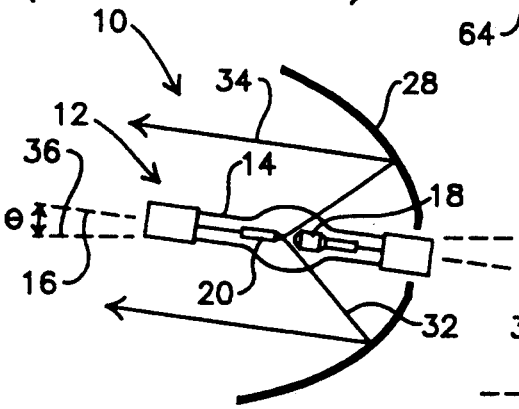
Fig.3c (Prior Art)

With reference also being made to FIG. 6, an electric motor 64 is mounted in the lower portion of the housing 42. A cam 66 is fixed to a shaft 64*a* of the motor 64 for integral rotation. The cam 66 is generally oval shaped, and has a peripheral surface 66*a* including a point 66*b* which is laterally spaced from the shaft 64*a* by a maximum distance and a point 66*c* which is laterally spaced from the shaft 64*a* by a minimum distance. The socket 50, lamp 12, socket 58 and pushrod 62 are urged downwardly by the spring 56 such that cam follower 62*a* is maintained in contact with the peripheral surface 66*a* of the cam 66.

The searchlight 40 is illustrated in the widest focus position in FIG. 4, in which the cam follower 62*a* engages the point 66*c* of the cam 66 and the lamp 12 is in the most downward position with the focus 30' closer to the anode 18 than at the point 26. The cam 66 is rotatable by means of the motor 64 to a most narrowly focussed position in which the cam follower 62*a* engages the point 66*b* of the cam 66 and the lamp 12 is in a most upward position in which the focus 30 coincides with the maximum intensity point 26 of the arc 25. The focus is continuously variable between these extreme positions by rotating the cam 66.

The arc 25 produced by the xenon-arc lamp 12 includes proportionally more short wavelength light, notably blue light, than in sunlight. The gold reflecting surfaces 43 and 44*d* of the reflector 28 and mirror 44 partially attenuate shorter wavelength light from blue through ultraviolet such that the beam 48 more closely approximates sunlight for better color rendition of illuminated objects.

Although gold is the preferred material for both reflecting layers 43 and 44*d*, it can be used for only one or the other of the layers 43 or 44*d*, with another material such as aluminum, silver or rhodium used for the other layer. Alternatively, it is within the scope of the invention to use a material other than gold for both layers 43 and 44*d*.

In the illustrated embodiment of the present searchlight 40, the mirror 44 has a flat reflecting surface. However, the flat mirror 44 can be replaced with a mirror having a different shape for special applications in which a beam having a shape other than circular is required. Representative alternative cross-sections for the mirror 44 include concave spherical, parabolic and elliptical for beam convergence; convex spherical and hyperbolic for beam divergence; and concave and convex cylindrical for a linear beam.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

We claim:

1. A searchlight, comprising:

a xenon-arc lamp having a longitudinal axis, and an anode and a cathode which are spaced from each other along said longitudinal axis, the xenon-arc lamp producing an arc which has proportionally more short wavelength light than is in sunlight and becoming inoperative when the anode is disposed below the cathode by more than a predetermined limit angle relative to horizontal that is determined by the characteristics of the lamp and is substantially closer to 0° than to 90°;

a first reflector which is rotatable with the xenon-arc lamp and has a concave reflecting surface for collecting light from said arc and reflecting said collected light generally parallel to said longitudinal axis as a beam; and a second reflector which is rotatable with the xenon-arc lamp for receiving said beam from the first reflector and reflecting said beam away from said longitudinal axis by a predetermined reflection angle;

at least one of said first and second reflectors having a reflective surface formed of a material which reflects proportionally less short wavelength light than is in sunlight, such that said beam after reflection from the second reflector more closely approximates sunlight than does the proportionally more short wavelength light than is in sunlight in said arc.

2. A searchlight as in claim 1, in which said predetermined reflection angle is substantially 90°.

3. A searchlight as in claim 1, in which:

said arc has an intensity which is maximum at a point near the cathode and decreases from said point toward the anode;

said concave reflecting surface of the first reflector faces the xenon-arc lamp and has a parabolic cross-section with a focus; and the searchlight further comprises focussing means for causing relative displacement between the first reflector and the xenon-arc lamp along said longitudinal axis between a first position in which said focus substantially coincides with said point and a second position in which said focus is spaced from said point toward the anode.

4. A searchlight as in claim 3, in which the anode is disposed between the cathode and the first reflector.

5. A searchlight as in claim 1, in which the second reflector has a flat reflecting surface.

6. A searchlight as in claim 1, in which said material which reflects proportionally less short wavelength light than is in sunlight comprises gold.

7. A searchlight, comprising:

a rotatable xenon-arc lamp having a longitudinal axis, and an anode and a cathode which are spaced from each other along said longitudinal axis, the xenon-arc lamp becoming inoperative when the anode is disposed below the cathode at more than a predetermined limit angle relative to horizontal that is determined by the characteristics of the lamp and is substantially closer to 0° than to 90°;

a first reflector which rotates with the xenon-arc lamp, collects light from said lamp and reflects said collected light as a beam; and a second reflector which rotates with the xenon-arc lamp for receiving said beam from the first reflector and reflecting said beam away from said longitudinal axis by a predetermined reflection angle, said searchlight being rotatable in a vertical plane over a range that exceeds said limit angle on opposite sides of a vertical axis but is no greater than the sum of 90° plus said limit angle from vertical, and thereby permits the beam reflected from said second reflector to be swept through an angular range that extends both above and below a horizontal plane by more than said predetermined limit angle, the rotation of said searchlight in said vertical plane being limited so that its anode does not rotate to a position lower than its cathode by more than said limit angle.

8. A searchlight as in claim 7, wherein said first reflector has a concave reflecting surface and reflects light from said lamp generally parallel to said longitudinal axis, and said second reflector reflects said beam away from said longitudinal axis by about 90°.

9. A searchlight as in claim 8, wherein said searchlight is rotatable in a vertical plane over a range of about 180°, with said anode disposed approximately vertically over said cathode at the middle of said range.

10. A searchlight as in claim 7, wherein at least one of said first and second reflectors has a reflecting surface that reflects proportionally less short wavelength light than is in sunlight, such that said beam after reflection from said second reflector more closely approximates sunlight than does the proportionally more short wavelength light that is in sunlight in said arc.

11. A searchlight as in claim 10, wherein said at least one reflecting surface that reflects proportionally less short wavelength light than is in sunlight comprises gold.

* * * * *